United States Patent [19]

Heiman

[11] Patent Number: 4,670,326

[45] **Date of Patent: * Jun. 2, 1987**

[54] WOVEN SHEETING MATERIAL AND METHOD OF MAKING SAME

[75] Inventor: Gary L. Heiman, Jerusalem, Israel

[73] Assignee: Standard Textile Company, Inc., Cincinnati, Ohio

[ * ] Notice: The portion of the term of this patent subsequent to Mar. 25, 2003 has been disclaimed.

[21] Appl. No.: 801,213

[22] Filed: Nov. 25, 1985

Related U.S. Application Data

[62] Division of Ser. No. 524,187, Aug. 17, 1983, Pat. No. 4,578,306.

[51] Int. Cl.[4] ..... D03D 15/00

[52] U.S. Cl. ..... 428/225; 139/420 R; 139/420 A; 139/420 B; 139/426; 428/229; 428/259

[58] Field of Search ..... 139/420 R, 420 A, 420 B, 139/426; 428/229, 259, 225

[56] References Cited

U.S. PATENT DOCUMENTS

| | | | |
|---|---|---|---|
| 776,275 | 11/1904 | Valentine et al. | 139/428 |
| 1,139,705 | 5/1915 | Murch | 139/427 |
| 2,417,320 | 3/1947 | Nutter | 139/427 |
| 3,446,658 | 5/1969 | Rose | 428/259 |
| 3,484,332 | 12/1969 | Fuhr | 428/259 |
| 3,642,561 | 2/1972 | Grobner | 428/259 |
| 4,191,221 | 3/1980 | Boyer | 139/426 R |
| 4,573,500 | 3/1986 | Douglas | 139/426 R |

OTHER PUBLICATIONS

Pajgrt et al, Processing of Polyester Fibers, SNTL, Progue (Elsevier, New York, NY Distrib.) 1979, pp. 147–152, 156–159 and 161.

Richardson et al; in Advances in Textile Processing, vol. 1, Lynn et al, Edits., Interscience, New York, N.Y., 1961, pp. 120–126.

Cook I, Handbook of Textile Fibers–I. Natural Fibers, Fouret Edit., et al, Merrow, Watford, Herts., England, 1968, pp. 72–73.

Cook II, Handbook of Textile Fibers–II. Man Made Fibers, Fourth Edit., Merrow, Watford, Herts., England, 1968, pp. 390–391 and 394–395.

Valko in Man-Made Fibers, Science and Technology, vol. 3, Mark et al., edits., Interscience, New York, N.Y., 1968, pp. 526–527.

*Primary Examiner*—James C. Cannon

*Attorney, Agent, or Firm*—Kinney & Schenk

[57] ABSTRACT

A woven sheeting material and method of making same are provided wherein such sheeting material has warps and wefts and each of the warps is made of a blend of a natural material and a synthetic material and each of the wefts is made substantially entirely of the natural material.

19 Claims, 3 Drawing Figures

WOVEN SHEETING MATERIAL AND METHOD OF MAKING SAME

This is a division of application Ser. No. 524,187 filed Aug. 17, 1983, now U.S. Pat. No. 4,578,306.

BACKGROUND OF THE INVENTION

1. Field of the Invention

This invention relates to woven sheeting material and in particular to plainwoven sheeting material for institutional use and to a method of making the same.

2. Prior Art Statement

It is known in the art to provide woven sheeting material, such as, plainwoven sheeting material for institutional use wherein such institutions include hospitals, nursing homes, rest homes, and the like. However, the sheeting material proposed previously for institutional use is made in what is referred to as a balanced weave utilizing substantially the same number of warps and wefts in each unit of surface area, such as a square inch, for example, of the sheeting material. Further, the sheeting material proposed previously for institutional use employs a blend of natural material and synthetic material in both the warps and wefts thereof whereby with the usual blend of natural and synthetic material defining each warp or weft there are generally equal quantities or considerably more synthetic material than natural material in the previously proposed sheeting material whereby such previously proposed sheeting material has certain deficiencies which will now be described.

The provision of sheeting material having substantial quantities of synthetic materials therein, such as a polyester, results in a material in which stains are very difficult to remove. This phenomenon is due to the fact that a synthetic material is basically oleophylic and thereby has a tendency to attract oils, such as body oils emitted from the body of a patient, for example.

There is also a tendency for sheeting material having substantial quantities of synthetic materials to become dull and unattractive after about 100 institutional laundry cycles, where a laundry cycle comprises washing, drying, ironing and possibly steam sterilization of a particular sheeting material. Even though such sheeting material is usable after 100 of such cycles there is a tendancy to discard such sheeting material because of its poor appearance.

Sheeting material which has been proposed previously for institutional use often is provided with a chemical no-iron surface treatment or finish. Such a treatment tends to degrade cotton fibers of the sheeting material and further tends to make the removal of stains, particularly oleophylic stains, even more difficult.

SUMMARY OF THE INVENTION

This invention provides an improved woven sheeting material having warps and wefts wherein such sheeting material overcomes the above-mentioned deficiencies.

In accordance with one embodiment of this invention each of the warps is made of a blend of a natural material and a synthetic material and each of the wefts is made substantially entirely of the said natural material.

In accordance with another embodiment of this invention a plainwoven sheeting material for institutional use is provided which has warps and wefts and is free of surface treatment to thereby require ironing thereof; and, each of the warps of such sheeting material is made of a blend of cotton and polyester and each of the wefts is made of cotton.

Accordingly, it is an object of this invention to provide an improved sheeting material of the character mentioned.

Another object of this invention is to provide an improved plainwoven sheeting material for institutional use of the character mentioned.

Another object of this invention is to provide an improved method of making a sheeting material of the character mentioned.

Other features, objects, uses, and advantages of this invention are apparent from a reading of this description which proceeds with reference to the accompanying drawing forming a part thereof.

BRIEF DESCRIPTION OF THE DRAWING

The accompanying drawing shows present preferred embodiments of this invention, in which.

DETAILED DESCRIPTION

Figure 1:
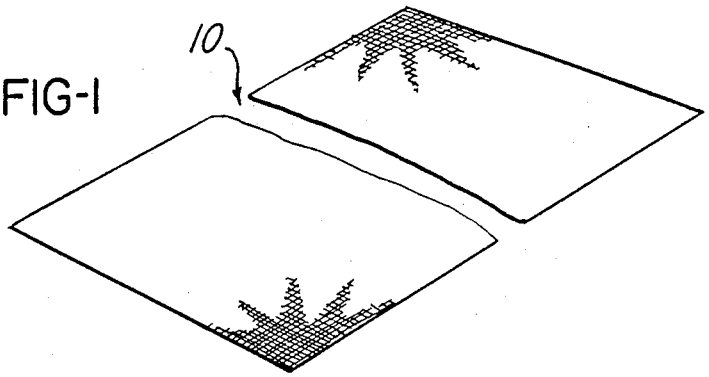
FIG. 1 is an isometric view with the central portion thereof broken away illustrating one exemplary embodiment of the sheeting material of this invention.
Figure 2:
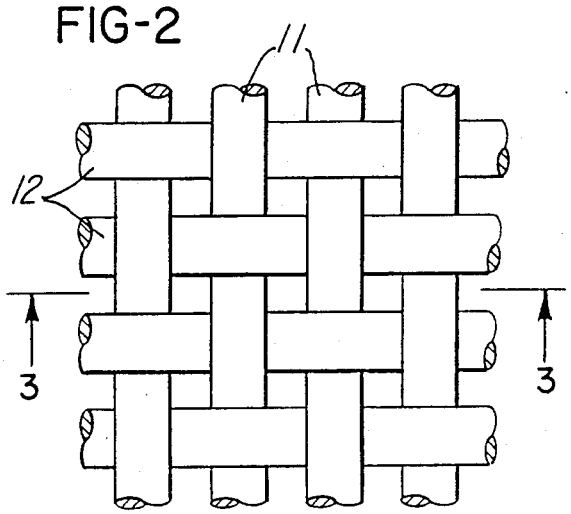
FIG. 2 is an enlarged fragmentary plan view particularly illustrating the warps and wefts of the sheeting material of FIG. 1.
Figure 3:
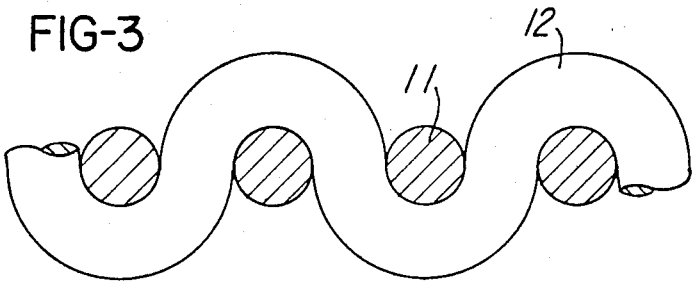
FIG. 3 is a view taken essentially on the line 3—3 of FIG. 2.

Reference is now made to FIG. 1 of the drawings which illustrates one exemplary embodiment of the sheeting material of this invention which is designated generally by the reference numeral 10. The sheeting material 10 is a plainwoven material particularly adapted for institutional use and has wraps 11 extending in one direction along such sheeting material in substantially parallel relation and has wefts 12 extending in parallel relation in another direction which in this example is perpendicular to the direction of the warps and as is known in the art for a plainwoven material.

The sheeting material 10 is free of surface treatment and thereby requires ironing. This requirement for ironing in institutional sheeting material is particularly desirable because it tends to reduce pilferage.

Most previously proposed institutional sheeting materials are made in a so-called balanced weave, i.e., the same number of warps and wefts per square inch. However, in the sheeting material 10 the number of warps 11 in a unit area, such as a square inch thereof, is greater than the number of wefts 12 and the total number of warps and wefts in any square inch thereof is generally of the order of 190. This reference to generally of the order of 190 is intended to indicate that between 185 and 200 warps and wefts per square inch are provided. In one particular example, 192 warps and wefts per square inch were provided with 110 of this number being warps and 82 being wefts.

As previously mentioned, each of the warps 11 is made of a blend of natural material and synthetic material. Preferably each of the warps 11 consists of from 40% natural material and 60% synthetic material to 60% natural material and 40% synthetic material. In one specific example of the sheeting material 10 the warps consisted of a blend of 50% natural material and 50% synthetic material.

The natural material of the warps and wefts is preferably cotton and defines approximately 70% by weight of the sheeting material 10 thereby providing a light weight, high moisture absorbency, and softness in such sheeting material. In one example cotton constituted 72% by weight of the sheeting material 10.

The sheeting material 10 is woven such that the cotton of the warps 11 and wefts 12 also defines approximately 80% of the surface area of such sheeting material, and it will be appreciated that with this large amount of cotton defining the surface area there is a minimum tendency for pilling by the loose or broken ends of the synthetic material.

Although any suitable synthetic material may be used to define the warps 11 of the sheeting material 10, such synthetic material is preferably polyester. The preferred natural material used in the warps 11 and wefts 12 is cotton and preferably is in the form of a long staple combed cotton. In a particular example of the sheeting material each warp 11 consisted of 50% cotton and 50% polyester.

Although the natural material comprising the warps and wefts in the exemplary material 10 is described as being preferably cotton, it will be appreciated that other natural materials may be utilized. For example, in applications where expense is not of paramount importance wool, silk, and the like may be utilized. Likewise synthetic materials other than polyester may be utilized provided that the selected synthetic material is easy to blend with the natural material which is being utilized and such selected synthetic material is also easy to weave as a plain weave.

The sheeting material 10 has comparatively higher tensile strength in the warp direction than in the weft direction. This is due to the utilization of polyester in the warps which has a comparatively high tensile strength.

It will also be appreciated that with the provision of the sheeting material 10 having approximately 70% by weight of cotton and a surface area made of approximately 80% cotton, as previously mentioned, the advantages of cotton are preeminent. In particular, cotton provides its well known luxurious feel and touch and greater comfort than sheeting material made with large amounts of synthetic material. It is also comparatively easier to remove stains from cotton. In addition, the utilization of substantial amounts of cotton in the sheeting material 10 enables the provision of such sheeting material for institutional use in colors which retain their brightness.

The utilization of a natural material, such as cotton, to define generally of the order of 70% by weight of the sheeting material 10 enables such sheeting material to be subjected to numerous laundry cycles without destroying what is often referred to as the brightness and cleanliness of such sheeting material. In comparing sheeting material 10 with previously proposed sheeting materials which utilize substantial amounts of synthetic materials, such as polyester, it was found that such previously proposed sheeting materials became dull and their brightness was greatly diminished after about 100 institutional laundry cycles, as previously defined. However, the sheeting material 10 retains its bright clean appearance after 150 institutional laundry cycles and in some instances after as many as 200 such cycles.

The sheeting material 10 is made with its exposed surfaces free of special treatment or finish. In this manner chemicals which tend to degrade and weaken the fibers and/or filaments defining the warps 11 and wefts 12 and which also tend to retain stains thereon are avoided.

It will also be appreciated that the sheeting material 10 with substantial amounts of cotton comprising the same lends itself to the provision of colored selvages for instant identification of size and product. In this context it will be recognized that the reference to sheeting material means bed sheets, whether flat or contoured; pillowcases, so-called draw sheets, or products for hospital surgical procedures made from this sheeting.

Throughout this disclosure reference has been made to warps 11 and wefts 12 of the sheeting material 10. However, it is to be understood that warps 11 means warp threads or yarns and wefts 12 means weft, i.e., fill, threads or yarns and as is known in the art.

While present exemplary embodiments of this invention, and methods of practicing the same, have been illustrated and described, it will be recognized that this invention may be otherwise variously embodied and practiced within the scope of the following claims.

What is claimed is:

1. In a woven sheeting material having warps and wefts the improvement wherein each of said warps is made of a blend of a natural material and a synthetic material and each of said wefts is made substantially entirely of said natural material.

2. A sheeting material as set forth in claim 1 which is plainwoven.

3. A sheeting material as set forth in claim 2 in which the number of warps in any square inch thereof is greater than the number of wefts and the total number of warps and wefts in said square inch is generally of the order of 190.

4. A sheeting material as set forth in claim 2 in which said blend in each of said warps consists of from 40 percent natural material and 60 percent synthetic material to 60 percent natural material and 40 percent synthetic material.

5. A sheeting material as set forth in claim 4 in which the natural material of said warps and wefts is cotton and defines approximately 70 percent by weight of said sheeting material thereby providing high moisture absorbency and softness.

6. A sheeting material as set forth in claim 5 in which said cotton also defines approximately 80 percent of the surface area of said sheeting material which results in minimum pilling.

7. A sheeting material as set forth in claim 4 in which said synthetic material of said warps is polyester.

8. A sheeting material as set forth in claim 6 in which said cotton is a combed cotton.

9. A sheeting material as set forth in claim 8 which is provided in a particular color.

10. A sheeting material as set forth in claim 1 in which the natural material of said warps and wefts is cotton.

11. A sheeting material as set forth in claim 1 in which the natural material of said warps and wefts is wool.

12. A sheeting material as set forth in claim 1 in which the natural material of said warps and wefts is silk.

13. A sheeting material as set forth in claim 1 in which the number of warps in any square inch thereof is generally of the order of 30 percent greater than the number of wefts.

14. In a plainwoven sheeting material for institutional use and having warps and wefts the improvement wherein each of said warps is made of a blend of cotton and polyester and each of said wefts is made entirely of cotton.

15. A sheeting material as set forth in claim 14 in which the number of warps in any square inch thereof is greater than the number of wefts and the total number of warps and wefts in said square inch is generally of the order of 190.

16. A sheeting material as set forth in claim 15 in which said blend in each of said warps consists of from 40 percent cotton and 60 percent polyester to 60 percent cotton and 40 percent polyester.

17. A sheeting material as set forth in claim 14 in which the number of warps in any square inch thereof is generally of the order of 30 percent greater than the number of wefts and the total number of warps and wefts in said square inch is generally of the order of 190.

18. In a method of making a sheeting material for institutional use comprising the steps of weaving warps and wefts in a plainwoven pattern the improvement comprising the steps of making each of said warps of a blend of cotton and polyester and making each of said wefts of cotton.

19. A method as set forth in claim 18 in which said weaving step comprises weaving by producing a number of warps in any square inch of said sheeting material which is generally of the order of 30 percent greater than the number of wefts.

* * * * *